US011118857B2

(12) United States Patent
Griffin et al.

(10) Patent No.: US 11,118,857 B2
(45) Date of Patent: Sep. 14, 2021

(54) SPIN-STABILIZING ASSEMBLY FOR A CYLINDRICAL BARREL USING HARVESTED PROPELLANT ENERGY

(71) Applicant: The Boeing Company, Chicago, IL (US)

(72) Inventors: Steven F. Griffin, Kihei, HI (US); Jacob A. Lucas, Makawao, HI (US); Alexander Klein, Kihei, HI (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/748,862

(22) Filed: Jan. 22, 2020

(65) Prior Publication Data

US 2021/0222984 A1 Jul. 22, 2021

(51) Int. Cl.
*F41A 21/36* (2006.01)

(52) U.S. Cl.
CPC ..... *F41A 21/36* (2013.01)

(58) Field of Classification Search
CPC ..... F41A 21/30; F41A 21/32; F41A 21/34; F41A 21/36; F41A 21/38; F41A 27/30; F42B 10/025; F42B 10/26; F42B 10/28; F41C 27/22
See application file for complete search history.

(56) References Cited

U.S. PATENT DOCUMENTS

| | | | | |
|---|---|---|---|---|
| 1,413,903 | A * | 4/1922 | Czegka | F41A 13/10 89/14.1 |
| 2,611,317 | A * | 9/1952 | Africano | F42B 10/30 244/3.23 |
| 3,414,217 | A * | 12/1968 | Kesting | F02K 9/78 244/3.23 |
| 5,186,413 | A * | 2/1993 | Deakin | F41J 9/10 102/388 |
| 8,581,160 | B1 * | 11/2013 | Sanford | F42B 10/025 244/3.1 |
| 10,415,918 | B1 * | 9/2019 | Paspaliaris | F41C 27/22 |
| 2007/0262203 | A1 * | 11/2007 | Saggio, III | B64D 39/00 244/135 A |
| 2016/0377372 | A1 * | 12/2016 | Hodgson | F41A 21/30 42/1.06 |
| 2020/0182580 | A1 * | 6/2020 | Williams | F41A 27/30 |

* cited by examiner

*Primary Examiner* — Gabriel J. Klein
(74) *Attorney, Agent, or Firm* — Quinn IP Law

(57) ABSTRACT

A spin-stabilizing assembly is usable with a cylindrical barrel having a longitudinal center axis, a vertical center axis, and a distal end. The assembly includes a gimbal piece, a spinner cage, and a spinner body. A first end of the gimbal piece engages an outer diameter surface of the barrel proximate the distal end. The spinner cage is configured to engage a second end of the gimbal piece, and to pivot with respect thereto about the vertical center axis. The spinner body is disposed radially within the spinner cage and defines multiple axial vanes. The vanes, in response to impingement on the axial vanes of exhaust gases discharged from the distal end of the barrel, rotate the spinner body about the longitudinal center axis. Rotation results in impedance along the vertical center axis which minimizes vertical displacement or motion of the distal end.

20 Claims, 3 Drawing Sheets

SPIN-STABILIZING ASSEMBLY FOR A CYLINDRICAL BARREL USING HARVESTED PROPELLANT ENERGY

BACKGROUND

Forces imparted by the rapid expulsion of pressurized exhaust gases from a distal end of a cylindrical barrel during a discharge of a firearm or another cylindrical mechanism event can impart a significant vertical force moment to the distal end. As will be appreciated by those of ordinary skill in the art, recoil is the forceful rearward displacement of the barrel and components connected thereto, with a major force component being directed along the barrel's longitudinal axis in a direction opposite that of the expelled exhaust gases. Such displacement occurs due to a conservation of momentum of the expelled exhaust gases, and in many applications, an accompanying projectile propelled by the exhaust gases. The recoil forces transmitted along the barrel axis can cause the distal end of the barrel to deflect along a vertical axis as the opposing end of the barrel reacts against a supporting surface. Compounding of such recoil forces may result when a series of such discharge events occurs in rapid succession.

The severity of recoil during a given discharge event is largely affected by the mass of the barrel and the various components connected thereto, as well as the speed and mass of the exhaust gases and projectile expelled from the barrel. In a firearm such as a repeating rifle, for instance, conventional approaches for reducing the effects of recoil include increasing the mass of the barrel and/or a stock of the firearm. Other solutions employ force-absorbing springs or recoil pads to absorb some of the recoil energy. Muzzle brakes or ported barrels are also used to reduce recoil by diverting exhaust gases exiting a muzzle end of the barrel away from the barrel axis. However, such approaches may be less than optimal in terms of the required modifications to the firearm or other device equipped with the above-noted barrel, and/or the ability to minimize the magnitude of vertical displacement of the barrel's distal end.

SUMMARY

The present disclosure relates to a gyroscopic spin-stabilizing assembly for use with a device having a cylindrical barrel from which exhaust gases are forcefully expelled as a result of combustion, pyrotechnic ignition, or controlled release of a pressurized gas or another pressurized fluid. Dynamic operation of the spin-stabilizing assembly is intended to reduce undesirable effects of recoil in a firearm or another device having such a barrel.

As a fundamental principle of operation of the present teachings, sustained rotation of a multi-vane portion of the spin-stabilizing assembly about a longitudinal center axis of the barrel, also referred to herein as the barrel axis, produces a substantial impedance along a vertical center axis of the barrel. The constituent components of the spin-stabilizing assembly cooperate to harvest energy from exhaust gases in a manner that reduces the degree to which the distal end of the barrel rises during a given discharge event. Some embodiments also reduce the magnitude of a force component transmitted along the longitudinal center axis in a direction opposite to that of the discharged exhaust gases, and in some applications, to that of an accompanying projectile. The added impedance, referred to herein as a negative impedance to indicate the downward-directed moment, ultimately minimizes upward vertical displacement of the distal end of the barrel without adversely affecting side-to-side barrel motion.

For illustrative consistency, the barrel-equipped device is exemplified herein as a handheld firearm such as a rifle, a handgun, or a shotgun. Such firearms may be configured to discharge a conical or spherical bullet, pellet, or other metallic or soft projectile via a rapid expulsion of exhaust gases from the barrel. Other embodiments may be readily envisioned within the scope of the disclosure, including those from which the exhaust gases are expelled from the barrel without an accompanying discharge of a projectile, and therefore the present disclosure is not limited to the art of firearms.

In a possible embodiment of the aforementioned firearm, the exhaust gases are produced by spark-ignited gunpowder or another suitable propellant contained in a cylindrical ammunition casing. Energy from the resulting increase in pressure from the rapidly-expanding combustion gases within the barrel ultimately discharges the projectile from a distal/muzzle end of the barrel at a high velocity. As noted above, the expelled exhaust gases produce recoil forces that are transmitted along the barrel axis in a direction diametrically opposite to that of the direction of travel of the exhaust gases and projectile. As these forces react against a surface—typically a shooter's body via an intervening stock—the muzzle end may deflect in an upward direction. Such an event is thus commonly referred to in the art as "muzzle rise" or "muzzle flip", and may be present to some extent both with and without discharge of an accompanying projectile, with various compositions of the exhaust gas, and with discharge events of brief or extended durations.

Also disclosed herein is a spin-stabilizing assembly for use with a cylindrical barrel having a longitudinal center axis/barrel axis, a vertical center axis, and a distal end. The spin-stabilizing assembly according to an exemplary embodiment includes a gimbal piece, a spinner cage, and a spinner body that is housed within the spinner cage. The gimbal piece has first and second ends. The first end of the gimbal piece engages an outer diameter surface of the barrel proximate the barrel's distal end. The spinner cage engages the second end of the gimbal piece, and also pivots with respect thereto about the vertical center axis. The spinner body, which is disposed radially within the spinner cage, defines multiple axial vanes. The axial vanes are collectively configured, in response to impingement on the axial vanes of the exhaust gases discharged from the distal end of the barrel, to rotate the spinner body about the longitudinal center axis and thereby minimize displacement of the distal end along the vertical center axis.

The assembly and/or the barrel may be optionally configured to reduce the magnitude of recoil forces transmitted along the barrel axis, thereby reducing perceived kick during a discharge event.

The first end of the gimbal piece may fully circumscribe the distal end of the barrel, and may be optionally connected to the barrel via one or more fasteners. The second end of the gimbal piece may define a pair of coaxial through-holes centered on the vertical center axis. The spinner cage in such an embodiment may define a pair of vertical posts each configured to engage a respective one of the pair of coaxial through-holes.

The gimbal piece may also include an annular hub proximate the first end and one or more stops or bumpers disposed radially within the annular hub. In such a configuration, a range of motion of the spinner cage with respect to the vertical center axis is limited by the stops or bumpers.

The spinner cage may include annular end rings joined by a plurality of axially-extending support members, two of which may define respective vertical posts. The axial support members in some disclosed embodiments include four equally-spaced axial support members disposed 90° apart from each other with respect to a circumference of the annular end rings, with the vertical posts being coaxially aligned along the vertical axis of the barrel.

Optionally, the spin-stabilizing assembly may include a rotary actuator that is connected to the spinner body and configured to selectively rotate the spinner body about the longitudinal center axis at a calibrated rotational speed.

Some embodiments of the spin-stabilizing assembly may also include a processor and a sensor. The processor in such embodiments is in communication with the rotary actuator. The sensors, e.g., an accelerometer, is connected to the distal end of the barrel in communication with the processor, and is configured to transmit an electronic signal to the processor indicative of a measured dynamic property of the distal end of the barrel along the vertical center axis, e.g., acceleration when the sensor is an accelerometer. The processor in such an embodiment may automatically adjust or maintain the rotational speed as needed in response to the electronic signal.

In a complimentary embodiment in which the rotational speed is held constant, a torque actuator may be connected to the gimbal piece and used to apply a controlled differential torque about the vertical axis. The magnitude of such a controlled differential torque may be determined in real time by the processor in a feedback loop to minimize vertical motion of the distal end, as measured by the accelerometer.

The barrel may be a component of a firearm configured to discharge a bullet, a pellet, or another suitable projectile through the distal end via expulsion of the exhaust gases. For instance, the firearm may be a repeating rifle, in which case the exhaust gases are a product of combustion of an application-suitable propellant within the barrel.

Also disclosed herein is a spin-stabilized device having a cylindrical barrel and a spin-stabilizing assembly. The barrel includes a distal end, a longitudinal center axis, and a vertical center axis, and is configured to expel exhaust gases through the distal end. The spin-stabilizing assembly in this embodiment includes a gimbal piece, a spinner cage, and a spinner housing. The gimbal piece has first and second ends, with the first end circumferentially surrounding and engaging an outer diameter surface of the barrel proximate the distal end. The second end defines a pair of coaxial through-holes centered on the vertical center axis.

The spinner cage in this particular embodiment defines a pair of vertical posts configured to engage the pair of through-holes. The spinner cage is pivotably connected to the second end of the gimbal piece about the vertical center axis via the vertical posts and through-holes. A spinner body disposed radially within the spinner cage defines multiple axial vanes. The axial vanes are collectively configured, in response to impingement of the exhaust gases on the axial vanes, to cause the spinner body to rotate about the longitudinal center axis and thereby minimize displacement of the distal end about the vertical center axis during expulsion of the exhaust gases from the barrel.

A method is also disclosed herein for assembling a spin-stabilizing assembly for use with a cylindrical barrel having a longitudinal center axis, a vertical center axis, and a distal end. An embodiment of the method includes supporting a spinner body having a plurality of axial vanes radially within a spinner cage via a set of bearings. The spinner cage includes a pair of annular end rings interconnected by an equally-spaced plurality of axially-extending support members. The method in this embodiment also includes inserting vertical posts of the spinner cage into coaxial through-holes of a gimbal piece. The gimbal piece has a cylindrical first end configured to connect to an outer diameter surface of the barrel proximate the distal end, and a second end that defines the coaxial through-holes.

The above summary is not intended to represent every possible embodiment or every aspect of the present disclosure. Rather, the foregoing summary is intended to exemplify some of the novel aspects and features disclosed herein. The above features and advantages, and other features and advantages of the present disclosure, will be readily apparent from the following detailed description of representative embodiments and modes for carrying out the present disclosure when taken in connection with the accompanying drawings and the appended claims.

Figure 1:
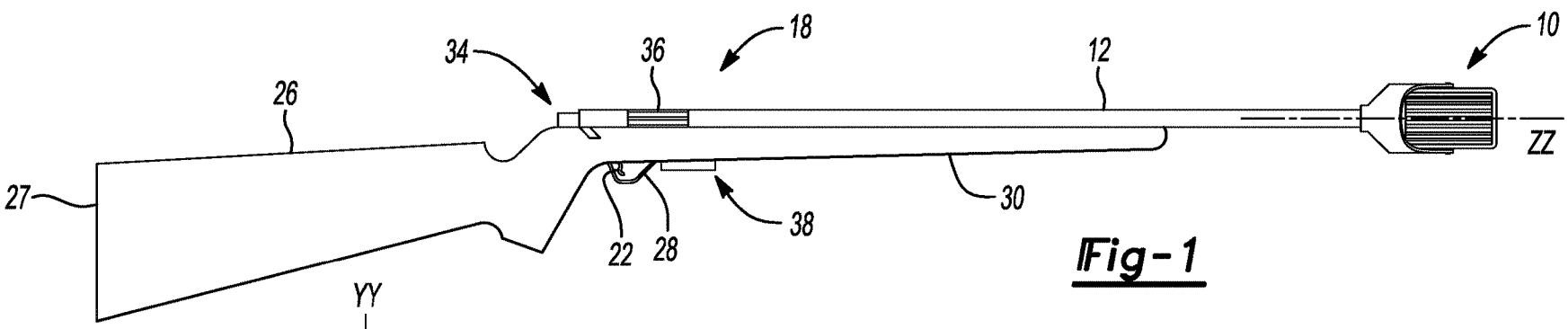
FIG. 1 is a schematic illustration of an exemplary device in the form of a firearm having a cylindrical barrel and a spin-stabilizing assembly connected thereto, with the spin-stabilizing assembly constructed as set forth herein.

The present disclosure is susceptible to modifications and alternative forms, with representative embodiments shown by way of example in the drawings and described in detail below. Inventive aspects of this disclosure are not limited to the disclosed embodiments. Rather, the present disclosure is intended to cover modifications, equivalents, combinations, and alternatives falling within the scope of the disclosure as defined by the appended claims.

DETAILED DESCRIPTION

Figure 1A:
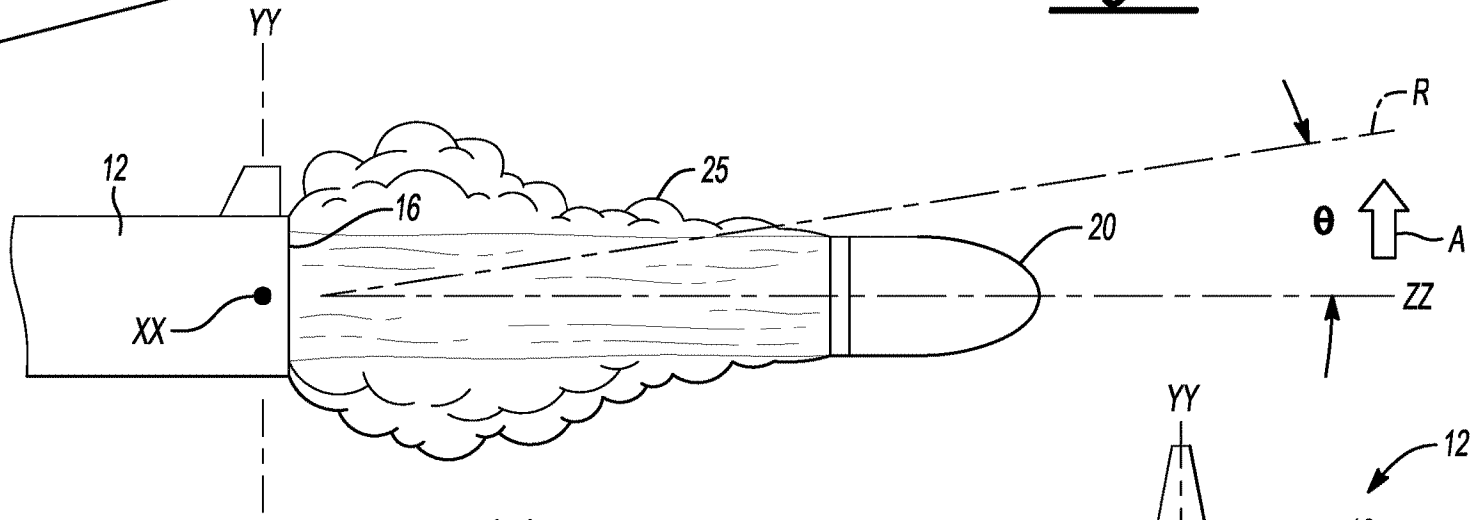
FIG. 1A is a schematic illustration of a representative discharge of the exemplary firearm shown in FIG. 1.

Referring to the drawings, wherein like reference numbers refer to the same or like components in the several Figures, a spin-stabilizing assembly 10 is schematically depicted in FIG. 1 that is configured for use with a cylindrical barrel 12 having a longitudinal center axis ZZ and a distal end 16 (see FIG. 1A). In an exemplary embodiment, the barrel 12 may be an integral component of a handheld firearm 18, with the representative firearm 18 of FIG. 1 being optionally embodied as a repeating centerfire or rimfire sporting rifle. The firearm 18 may be alternatively embodied as a handgun, a compressed air-powered pellet or BB gun, or any other firearm configured to discharge a projectile 20 toward a target as best shown in FIG. 1A.

The firearm 18 of FIG. 1 is just one possible beneficial application of the present spin-stabilizing assembly 10, however. Various other devices could benefit from the present teachings, such as but not limited to gaseous or liquid fluid discharge nozzles, compressed gas or air-powered tools, or fireworks launch tubes. Solely for illustrative consistency, the exemplary firearm 18 of FIG. 1 will be described hereinafter as an exemplary barrel-equipped device without limiting applications to such an embodiment.

Many factors affect the overall accuracy of a given firearm, such as the firearm 18 of FIG. 1. For instance, assuming a shooter maintains proper trigger control and that the firearm 18 is well maintained and in good mechanical working order, the resulting shot accuracy of the discharged projectile 20 of FIG. 1A may still be reduced by the disruptive effects of recoil. As will be appreciated by those of ordinary skill in the art, recoil is the rapid rearward displacement of the firearm 18 due to conserved momentum of the discharged projectile 20 and hot exhaust gases 25 expelled from the distal end 16 of the barrel 12, i.e., the muzzle end of the barrel 12. In a handheld firearm such as a rifle or a handgun, recoil momentum is quickly transferred to ground through the body of the shooter or via a tripod mount. Repeating firearms in particular may suffer from reduced shot accuracy during rapid-fire sequences due to compounding recoil.

When a trigger 22 of the representative firearm 18 shown in FIG. 1 is pulled, a resulting primer spark ignites a volume of propellent within an ammunition cartridge that is captive in the barrel 12 at a breach end 34 thereof. Rapidly-expanding combustion gasses 25 (FIG. 1A) from the ignited propellant increase the temperature and pressure within the barrel 12. The pressure ultimately propels the projectile 20 along the longitudinal center axis ZZ of the barrel 12, i.e., the barrel axis, and out through the distal end 16 shown in FIG. 1A. Alternatively, compressed air, $CO_2$, or another inert gas may be used to propel the projectile 20, and therefore the composition of the exhaust gases 25 expelled from the barrel 12 may vary within the scope of the disclosure.

Depending on the configuration of the firearm 18, recoil can result from a single-shot or multi-shot/repeating firing sequence at such a magnitude that shot accuracy is reduced. That is, as the exhaust gases 25 and the projectile 20 are expelled from the barrel 12 as shown schematically in FIG. 1A, equal and opposite reaction forces will cause a rapid rearward displacement of the firearm 18. Due to the construction of the firearm 18 and the reaction path of such recoil forces to ground, the distal end 16 of the barrel 12 may deflect quickly upward in the direction of arrow A at a deflection angle θ. Such vertical motion, which is commonly referred to in the art as "muzzle rise" or "muzzle flip" and is shown with respect to vertical center axis YY, can complicate aiming of subsequent shots as the shooter attempts to return the barrel 12 to its original firing alignment. Shot accuracy during rapid firing action of a repeating firearm in particular may be degraded due to minimal recovery time between successive shots. The present spin-stabilizing assembly 10 is therefore intended to reduce undesirable effects of such recoil in the firearm 18 of FIG. 1 or another device in which explosive exhaust gases 25 are rapidly expelled from the barrel 12 in a manner that may cause the barrel 12 to deflect upward along the vertical center axis YY.

Figure 1B:
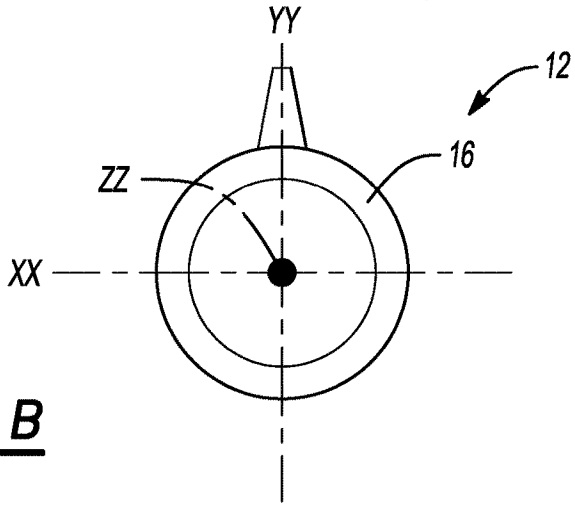
FIG. 1B is a schematic illustration of a distal muzzle end of a cylindrical barrel usable with the spin-stabilizing assembly of the present disclosure.

Referring briefly to FIG. 1B, the distal end 16 of the barrel 12, i.e., the muzzle end, is shown schematically as being aligned on the vertical center axis YY, a horizontal center axis XX, and the above-noted barrel axis ZZ, with the barrel axis ZZ being the longitudinal center axis of the barrel 12. Thus, recoil forces will tend to urge the distal end 16 upward in the direction of arrow A (FIG. 1A) such that axis ZZ is temporarily aligned on a recoil axis R. Operation of the spin stabilization provided by the spin-stabilizing assembly 10 of the present disclosure minimizes the magnitude of such displacement by applying substantial spin-based impedance along the vertical center axis YY. As a result, the longitudinal center axis ZZ, immediately after a shot is fired, remains as close as possible to the shooter's originally intended shooting alignment.

Referring once again to FIG. 1, the exemplary firearm 18 may include a stock 26 at a location aft of the trigger 22 and a surrounding trigger guard 28. A butt 27 of the stock 26 in the illustrated configuration, when held in a normal shooting position, may be adjacent to a shooter's shoulder. In such a position, the above-noted recoil forces will be transferred into the shooter's shoulder and other portions of the shooter's body at various points along the butt 27. The barrel 12 is supported in this particular embodiment by a fore stock 30, with the distal end 16 of the barrel 12 oppositely disposed relative to the chamber end 34. The chamber end 34 itself defines a chamber 36, with a reloadable ammunition magazine 38 located below the fore stock 30 containing ammunition cartridges (not shown). A manual bolt, also not shown but well understood in the art, may be used to manually cycle a cartridge into the chamber 36 and expel a spent casing from an immediately prior shot, or such a process may occur automatically via a spring and/or diverted exhaust gases 25 depending on the particular configuration of the firearm 18.

As shown in FIG. 1 and omitted for clarity in FIGS. 1A and 1B, the spin-stabilizing assembly 10 of the present disclosure is securely attached to the distal end 16 of the barrel 12. As described below with reference to FIGS. 2 and 3, the spin-stabilizing assembly 10 is configured to reduce recoil by harvesting excess energy from the exhaust gases 25 and projectile 20 of FIG. 1A. Such exhaust gases 25 impinge on portions of the spin-stabilizing assembly 10 to impart rotation to particular components thereof. Such rotation in turn presents a significant impedance to vertical motion of the barrel 12 along vertical center axis YY of FIG. 1A, which results from gyroscopic movement of the spin-stabilizing assembly 10. The spin-stabilizing assembly 10 may therefore be used to improve shot accuracy without impeding side-to-side motion of the barrel 12 along horizontal center axis XX of FIG. 1B.

Figure 2:
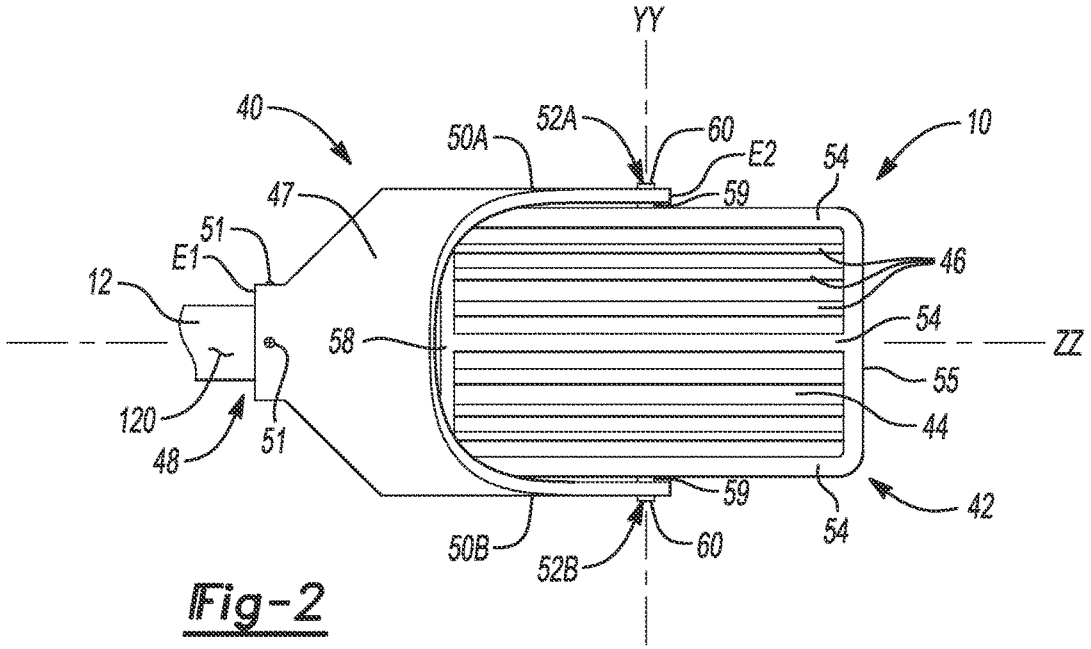
FIG. 2 is a schematic side view illustration of the spin-stabilizing assembly shown in FIG. 1.
Figure 3:
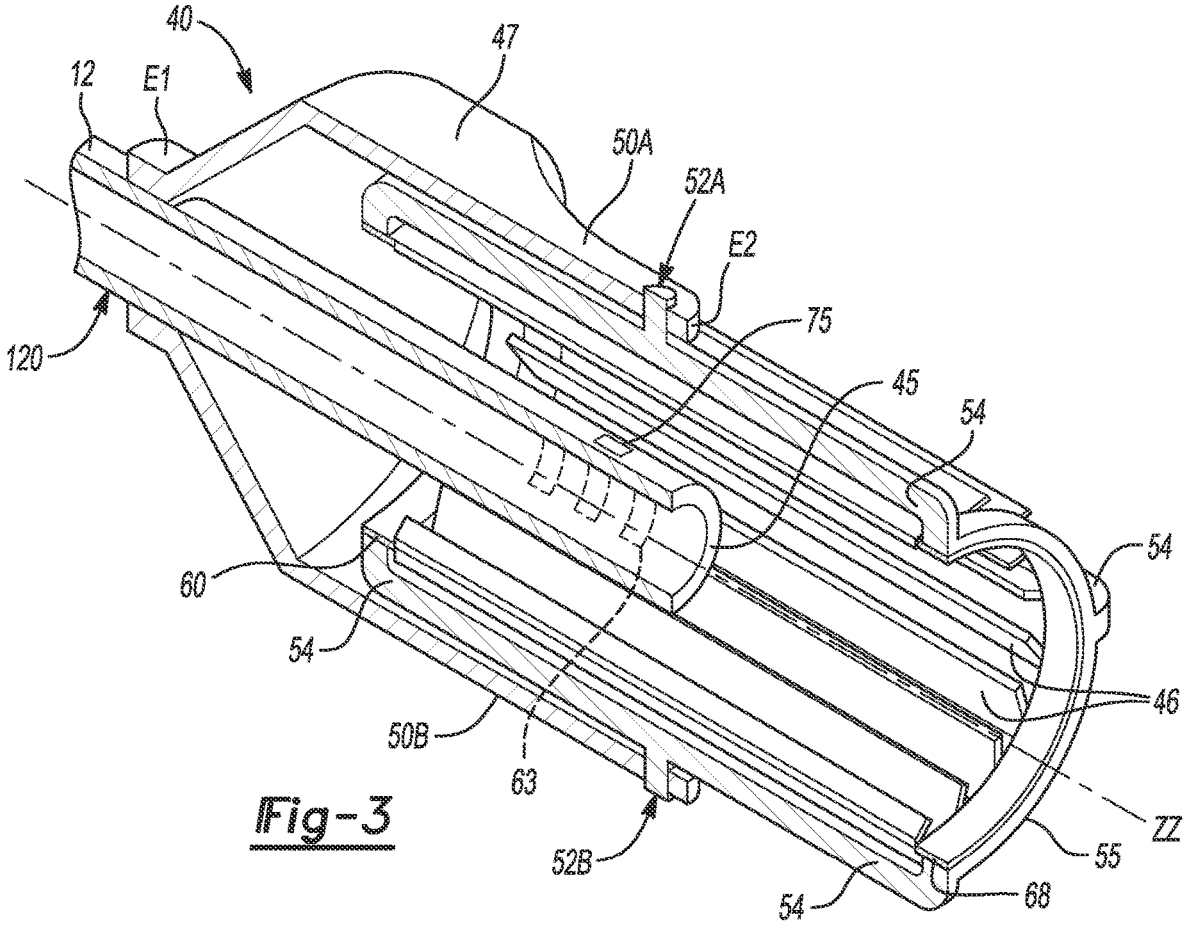
FIG. 3 is a cross-sectional perspective view illustration of the spin-stabilizing assembly shown in FIGS. 1 and 2.

In particular, and with reference to FIGS. 2 and 3, the spin-stabilizing assembly 10 in an exemplary embodiment includes a gimbal piece 40, a spinner cage 42, and a spinner body 44. The gimbal piece 40 has first and second ends E1 and E2, respectively, with the first end E1 configured to engage an outer diameter surface 120 of the barrel 12 proximate distal end 16 (see FIGS. 1A and 3), i.e., the muzzle end. The spinner cage 42 in turn is configured to engage the second end E2 of the gimbal piece 40 along the vertical center axis YY of barrel 12 in a manner that allows the spinner cage 42 to freely pivot about vertical center axis YY within a defined range of motion. For instance, at least one optional stop or bumper 58 may be attached to a distal end of the spinner cage 42 and/or disposed within the gimbal piece 40, with a range of motion of the spinner cage with respect to the vertical center axis being limited by the stop(s) or bumper(s) 58.

Figure 5:
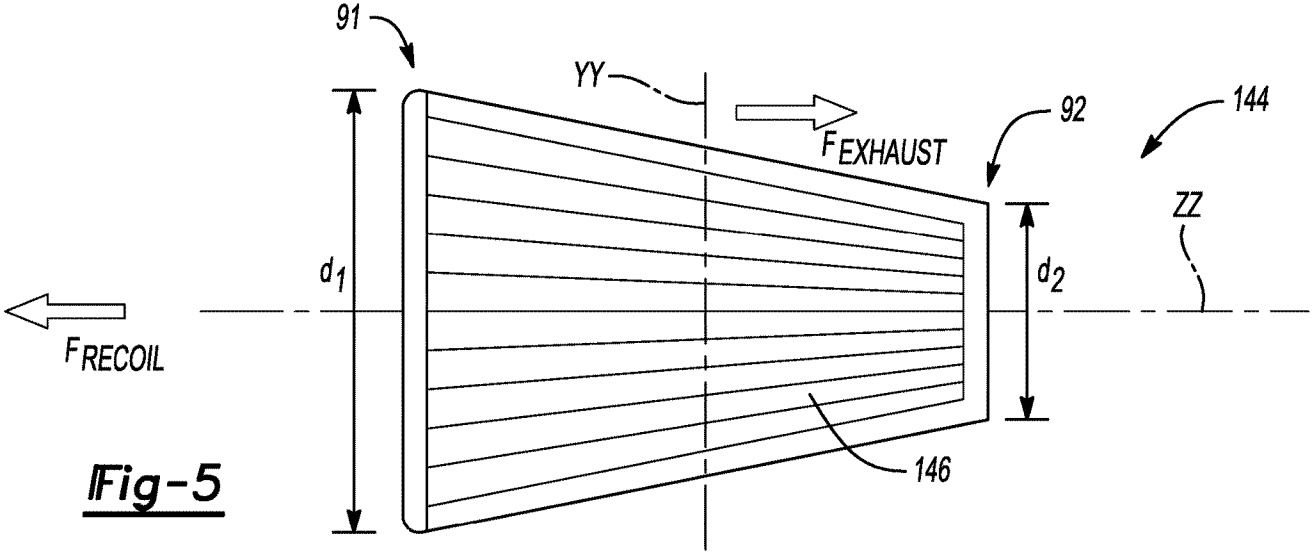
FIG. 5 is a schematic side view illustration of an alternative conical embodiment of a spinner body usable with the spin-stabilizing assembly of FIG. 2.

The spinner body 44 of FIG. 2 is positioned radially within the spinner cage 42 and defines multiple axial vanes 46. The spinner body 44 may be cylindrical as shown, or the spinner body 44 may have an alternative shape, e.g., the conical shaped spinner body 144 shown in FIG. 5. Referring briefly to FIG. 5, such a spinner body 144 may have circular first and second ends 91 and 92 with respective outer diameters $d_1$ and $d_2$. The outer diameter $d_1$ of first end 91 is greater than the outer diameter $d_2$ of second end E2. For instance, $d_1/d_2 \geq 2$ in some embodiments to help reduce the magnitude of recoil forces (arrow $F_{RECOIL}$) transmitted along the barrel axis/longitudinal center axis ZZ in a direction opposite to the exhaust forces (arrow $F_{EXHAUST}$).

Figure 4:
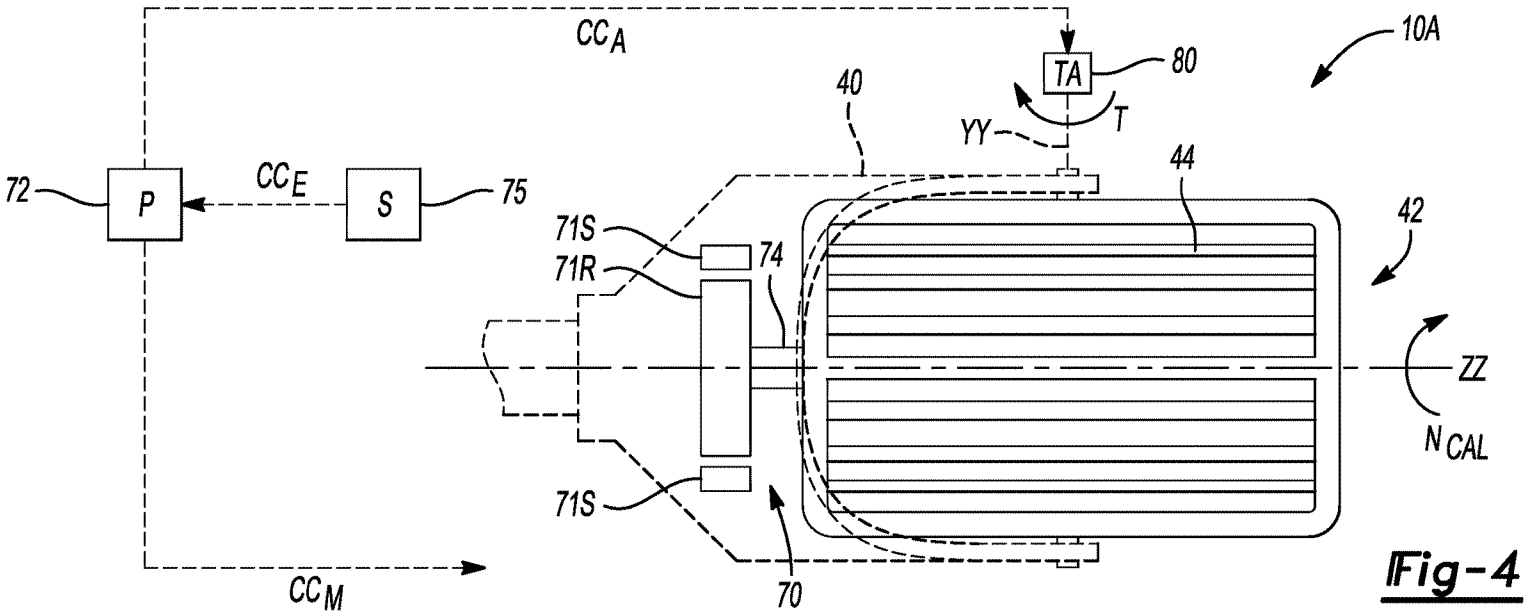
FIG. 4 is a schematic side view illustration of an alternative embodiment of the spin-stabilizing assembly shown in FIG. 2.

The axial vanes 46 may be rectangular in shape, or may be irregularly shaped and/or axially twisted in different embodiments, with the latter embodiment in the cylindrical spinner body 44 of FIG. 4 or the conical spinner body 144 of FIG. 5 possibly reducing the magnitude of recoil forces transmitted along the longitudinal center axis ZZ in a direction opposite to that of the exhaust gases 25 and projectile 20. Thus, a perceived amount of "kick" is reduced at the chamber end 34. The axial vanes 46 are collectively configured, in response to impingement of the exhaust gases 25 of FIG. 1A on the vanes 46 upon exiting the distal end 16 of the barrel 12, to rotate the spinner body 44 about the longitudinal center axis ZZ radially within the spinner cage 42, such that vertical displacement or rise of the distal end 16 is minimized.

With respect to the gimbal piece 40 of FIG. 2, which in the illustrated configurations is the only component of the spin stabilizing assembly 10 that is directly attached to the barrel 12, the gimbal piece 40 may be constructed of a rigid temperature-resistant material such as aluminum or steel. The gimbal piece 40 defines an annular opening 48 at its first end E1 that circumscribes the barrel 12 when the gimbal piece 40 is an installed position. The annular opening 48 may have a diameter that is slightly less than that of the barrel 12 so as to ensure a snug interference fit with the barrel 12. To further ensure that the gimbal piece 40 remains securely fastened around the outer diameter surface 120 of the barrel 12, threaded fasteners 51 may be used that pass through the first end E1 and partially into the barrel 12 at the outer diameter surface 120. In some embodiments, the outer diameter surface 120 may define a shallow circumferential groove (not shown), with the first end E1 defining a mating circumferential ring that, when the gimbal piece 40 is attached to the barrel 12, locks securely into the circumferential groove. Adhesives and other suitable attachment mechanisms may be used to ensure that the gimbal piece 40 remains securely attached to the distal end 16.

Once the gimbal piece 40 has been securely attached to the barrel 12, the gimbal piece 40 forms a fixed anchor for the remaining dynamic components of the spin-stabilizing assembly 10. To this end, the gimbal piece 40 may include a pair of axial arms 50A and 50B extending axially away from an annular hub 47 toward the distal end 16 of the barrel 12. The axial arms 50A and 50B terminate at the second end E2 of the gimbal piece 40. Each axial arm 50A and 50B may also define coaxial through-holes 52A and 52B, with the through-holes 52A and 52B being coaxially-aligned on the vertical center axis YY as shown.

The spinner cage 42, a portion of which is circumscribed by the hub 47 of the gimbal piece 40, may be cylindrical in its outer shape, or it may be conical to mate with the optional conical spinner body 144 of FIG. 5. Construction of the spinner cage 42 may include pair of annular end rings 55 joined together by a plurality of (two or more) axial support members 54. For instance, four equally-spaced axial support members 54 may be disposed 90° apart from each other as shown with respect to a circumference of the end ring 55. Additional axial support members 54 may be used in other embodiments to provide the requisite structural support. The total surface area of axial support members 54 should be minimized, however, so as not to impede flow of exhaust gases 25 expelled from the distal end 16 of the barrel 12.

Still referring to FIG. 2, a respective cylindrical post 59 may be attached to or integrally formed with two of the axial support members 54 at an approximate midpoint of a pair of the axial support members 54. A distal end 60 of each respective one of the cylindrical posts 59 is inserted into a respective one of the through-holes 52A and 52B of the axial arms 50A and 50B. For instance, the axial arms 50A and 50B may be flexed a short distance apart from each other to enable the posts 59 to be easily inserted into the through-holes 52A and 52B, whereupon the resiliency of the axial arms 50A and 50B secures the spinner cage 42 in the indicated position radially within the gimbal piece 40. In this manner, the posts 59 and the through-holes 52A and 52A together act as a rotational pivot for limited rotation of the spinner cage 42 about the vertical center axis YY, i.e., slight left-to-right or right-to-left motion of the spinner cage 42 when viewed from the perspective of FIG. 1B.

The spinner body 44 of FIGS. 2 and 3 is disposed radially within and supported by the spinner cage 42, e.g., via a set of bearings 68 or by direct sliding contact. As with the gimbal piece 40 and the spinner cage 42, the spinner body 44 may be constructed of aluminum, steel, or another application-suitable material resistant to the temperature and composition of the exhaust gases 25 of FIG. 1A. The spinner body 44 defines multiple axial vanes 46 as shown in FIG. 3, such as elongated rectangular or irregularly shaped panels or louvers oriented at a predetermined angle with respect to the longitudinal center axis ZZ. When the exhaust gases 25 of FIG. 1A are expelled from the distal end 16 of barrel 12, contact of the exhaust gases 25 with the presented surface area of the axial vanes 46 causes the spinner body 44 to rotate about axis ZZ radially within the spinner cage 42. Therefore, the angle of orientation of the vanes 46 and the axial position of the distal end 16 along the length of the spinner body 44 should be sufficient for imparting such rotation, e.g., with an angle of 30-45° and an approximate midpoint position of the distal end 16 being suitable in an exemplary embodiment.

Rotation of the spinner body 44 and pivoting of the spinner cage 42 of FIGS. 2 and 3 radially within the stationary gimbal piece 40 occurs in such a manner that vertical displacement or rise of the distal end 16 is impeded and minimized. In a repeating rifle embodiment of the illustrated firearm 18 of FIG. 1, for instance, the exhaust gases 25 will act on the exposed surfaces of the vanes 46 of the spinner body 44, thereby causing the spinner body 44 to rotate about axis ZZ. Repeated firing will tend to cause the spinner body 44 to rotate at increasing angular speeds until reaching a substantial steady-state speed. As the spinner body 44 rotates in response to vertical displacement of the barrel 12 along the vertical center axis YY of FIG. 1B, a gyroscopic gimbal assembly is effectively formed from the spinner cage 42 and spinner housing 44. As will be appreciated, such an assembly introduces significant impedance to up-and-down motion of the distal end 16, thereby reducing recoil-induced muzzle rise.

As shown schematically in FIG. 4, in a possible extension of the present teachings, a spin-stabilizing assembly 10A may include a rotary actuator 70 connected to the spinner cage 42 and powered by a small battery or other power supply (not shown). The rotary actuator 70, e.g., a small electric motor or other rotary device having a stator 71S connected to the gimbal piece 40 and a rotor 71R connected to the spinner cage 42, e.g., via a rotor shaft 74, may be housed within and/or attached to the hub 47 of the gimbal piece 40. Such a rotary actuator 70 may be configured to rotate the spinner body 44 about the longitudinal center axis ZZ at a calibrated rotational speed ($N_{CAL}$). Such a speed may be fixed, with the spinner body 44 constantly rotating irrespective of a discharge of the exhaust gases 25. Alternatively, the speed may be variable, with real-time dynamics of the spin-stabilizing assembly 10A used as control inputs to regulate the speed of the spinner cage 42.

The spin-stabilizing assembly 10A may optionally include a processor (P) 72 in communication with the rotary actuator 70, e.g., via transfer conductors or a wireless/BLUETOOTH connection. The processor 72 may be programmed to regulate operation of the rotary actuator 70 in response to electronic signals (arrow $CC_E$) from a sensor (S) 75. In a non-limiting exemplary embodiment, the sensor 75 may be an accelerometer connected to distal end 16 of the barrel 12, as shown in FIG. 3, with the sensor 75 being in wired or wireless communication with the processor 72. Such an accelerometer may be configured to transmit the electronic signals (arrow $CC_E$) to the processor 72, with the electronic signals (arrow $CC_E$) being indicative of a measured acceleration of the distal end 16 of barrel 12 along the vertical center axis YY. The processor 72 in turn may be configured to adjust the rotational speed of the spinner housing 44 in response to such electronic signals (arrow $CC_E$), e.g., via motor control signals (arrow $CC_M$).

As shown schematically in FIG. 4, the spin-stabilizing assembly 10A may also include a torque actuator (TA) 80 connected to the gimbal piece 40. A feedback loop is formed by the rotary actuator 70, the sensor 75, the processor 72, and the torque actuator 80. In such a feedback loop, the torque actuator 80, which is in communication with the processor 72 via hard-wired transfer conductors or wireless channels, selectively outputs a differential torque (T) about the vertical axis YY as needed in response to actuator control signals (arrow $CC_A$) from the processor 72.

In a possible feedback loop-based control method, the rotational speed of the spinner body 44 may be held constant via control of the rotary actuator 70. The processor 72 may receive a measured vertical acceleration from the sensor 75. The processor 72 may thereafter generate the actuator control signals (arrow $CC_A$) in response to the electronic control signals (arrow $CC_E$) from the sensor 75, and transmit the actuator control signals (arrow $CC_A$) to the torque actuator 80. The actuator control signals (arrow $CC_A$) effectively command the differential torque (T) from the torque actuator 80 at a magnitude sufficient for minimizing vertical motion of the distal end 16 of barrel 12. The torque actuator 80 is configured, in response to the actuator control signals (arrow $CC_A$), to apply the differential torque (T) about the vertical center axis (YY) as noted above.

Using an illustrative and non-limiting mathematical example to illustrate the relevant physics at play in the disclosed spin-stabilizing assembly 10 or 10A, rotational kinetic energy (E) can be expressed as $E=\frac{1}{2}I\omega^2$, where I is the moment of inertia and ω is angular velocity. The moment of inertia of a rotating thin-walled cylinder of radius r may be expressed as $I_{cylinder}=mr^2$. From these equations, it follows that the rotational kinetic energy of a thin-walled cylinder with a mass m, radius r, and angular velocity ω may be expressed as $E=\frac{1}{2}mr^2\omega^2$.

In order to match a particular angular velocity, e.g., 10,000 RPM or 1,047 rad/s for the purposes of illustration, a cylinder having a mass of 200 g and a radius of 2 cm would require approximately 44 Joules of energy. The energy density of propellant used in a given cartridge of the firearm 18 shown in FIG. 1, or of another exhaust gas 25 in other embodiments, may vary with its particular chemical composition. Again for the purposes of illustration, one may assume an exemplary mass of propellant of 25 grains (1.62 g), which is equivalent to 12,150 Joules of energy. If the projectile 20 of FIG. 1A leaves the barrel 12 with 1,900 Joules of energy, this would leave 10,250 Joules of energy. A significant portion of this remaining energy is lost as heat, recoil, cartridge expansion, etc. However, as only 44 Joules is needed to counter the 10,000 RPM impetus in this example, a single shot should produce sufficient energy to realize the disclosed spin stabilization benefits.

As explained above, the gyroscopic action of the spin-stabilizing assembly 10 minimizes muzzle rise, i.e., vertical displacement of the distal end 16. However, as will be appreciated by those of ordinary skill in the art, reduction of muzzle rise does not itself necessarily have the effect of reducing the magnitude of a recoil force component projected along the longitudinal center axis ZZ in a direction opposite to that of the expelled exhaust gases 25 and projectile 20 of FIG. 1A. Such forces are perceived as undesirable kick by a shooter as the forces are transmitted through the intervening stock 26 and butt 27 of the firearm 18 shown in FIG. 1. Such kick may be quite forceful depending on the configuration of the firearm 18 and the particular caliber of ammunition fired thereby. It may be desirable, therefore, to modify the firearm 18 and/or the spin-stabilizing assembly 10 to also reduce the magnitude of such forces along the barrel axis.

Therefore, optional embodiments for reducing perceived kick in the above-described firearm 18 or other devices may harvest energy from the exhaust gases 25 in a manner that reduces or counters the recoil force component transmitted along the longitudinal center axis ZZ. For instance, the barrel 12 may be equipped with and/or itself may define angled ports 63 that direct some of the expelled exhaust gases 25 in a downward and rearward direction relative to the vertical and longitudinal center axes YY and ZZ, respectively. Three such ports 63 are depicted schematically in FIG. 3 having an oval shape, with other numbers, shapes, and/or positions with respect to the distal end 16 being possible within the scope of the disclosure. The ports 63 may be part of an external muzzle brake in some embodiments, in which case the spin-stabilizing assembly 10 should be sized accordingly to accommodate such a brake. Alternatively or in conjunction with such ports 63, the vanes 46 of the spinner body 44 may be axially twisted and/or angled to enable exhaust gases 25 to impinge upon or contact the vanes 46 in a predetermined manner to produce a similar kick-reducing effect. Likewise, other recoil-reducing devices such as recoil pads or springs may be used in conjunction with the spin-stabilizing assembly 10.

The above description lends itself to performance of associated assembly methods. For example, a method for assembling the spin-stabilizing assembly 10 for use with the cylindrical barrel 12 may be envisioned. Such a method may entail supporting the spinner body 44 of FIGS. 2 and 3, with its plurality of axial vanes 46, radially within the spinner cage 42 via the bearings 68, and then inserting the vertical posts 59 (FIG. 2) of the spinner cage 42 into the coaxial through-holes 52A and 52B of the gimbal piece 40. Some embodiments of the method may include connecting the resulting spin-stabilizing assembly 10 to the distal end 16 of the barrel 12, e.g., of the firearm 18 of FIG. 1 or another barrel-equipped device as set forth above. As shown in FIG. 4, the method may optionally include connecting the rotor 71R of the rotary actuator 70 to the spinner body 44, e.g., via a fastener or splines (not shown), and connecting the stator 71S of the rotary actuator 70 radially within the first end E1 of the gimbal piece 40.

As will be appreciated by those of ordinary skill in the art in view of the foregoing disclosure, the stabilizing gyroscopic effect of the disclosed spin-stabilizing assemblies 10 and 10A may be beneficial in a host of applications experiencing recoil in response to the discharge of exhaust gases 25 (FIG. 1A) through the distal end 16 of the cylindrical barrel 12. The described embodiments stabilize motion along the vertical center axis YY, leaving side-to-side motion along the horizontal center axis XX unimpeded. Although omitted from the drawings for illustrative simplicity, one may add another gimbal device radially outside of the spinner cage 42 and centered on the horizontal center axis XX to help improve stability on the horizontal center axis XX. Therefore, the present teachings are not limited to the disclosed embodiments and representative firearm 18 of FIG. 1.

While some of the best modes and other embodiments have been described in detail, various alternative designs and embodiments exist for practicing the present teachings defined in the appended claims. Those skilled in the art will recognize that modifications may be made to the disclosed embodiments without departing from the scope of the present disclosure. Moreover, the present concepts expressly include combinations and sub-combinations of the described elements and features. The detailed description and the drawings are supportive and descriptive of the present teachings, with the scope of the present teachings defined solely by the claims.

What is claimed is:

1. A spin-stabilizing assembly for use with a cylindrical barrel having a longitudinal center axis, a vertical center axis, and a distal end, the spin-stabilizing assembly comprising:

a gimbal piece having a first end and a second end, wherein the first end of the gimbal piece circumscribes the distal end of the barrel, and is configured to engage an outer diameter surface of the barrel proximate the distal end via one or more fasteners;

a spinner cage having a pair of annular end rings joined by a plurality of axially-extending support members, the spinner cage being configured to engage the second end of the gimbal piece, and to pivot with respect thereto about the vertical center axis; and a spinner body disposed radially within the spinner cage and defining multiple axial vanes, wherein the axial vanes are collectively configured, in response to impingement on the axial vanes by exhaust gases discharged from the distal end of the barrel, to rotate the spinner body about the longitudinal center axis and thereby minimize displacement of the distal end of the barrel along the vertical center axis.

2. The spin-stabilizing assembly of claim 1, wherein the second end of the gimbal piece defines a pair of coaxial through-holes centered on the vertical center axis, and the spinner cage defines a pair of vertical posts each configured to engage a respective one of the pair of coaxial through-holes.

3. The spin-stabilizing assembly of claim 1, wherein the gimbal piece includes an annular hub proximate the first end and one or more stops or bumpers disposed radially within the annular hub, and wherein a range of motion of the spinner cage with respect to the vertical center axis is limited by the stops or bumpers.

4. The spin-stabilizing assembly of claim 2, wherein two of the axially-extending support members define a respective one of vertical posts.

5. The spin-stabilizing assembly of claim 1, wherein the plurality of axial support members includes four equally-spaced axial support members disposed 90° apart from each other with respect to a circumference of the annular end rings.

6. The spin-stabilizing assembly of claim 1, further comprising a rotary actuator connected to the spinner body and configured to selectively rotate the spinner body about the longitudinal center axis at a calibrated rotational speed.

7. The spin-stabilizing assembly of claim 6, further comprising:

a processor in communication with the rotary actuator; and an accelerometer connected to the distal end of the barrel in communication with the processor, wherein the accelerometer is configured to transmit an electronic signal to the processor indicative of a measured acceleration of the distal end of the barrel along the vertical center axis, and wherein the processor is configured to adjust the rotational speed in response to the electronic signal.

8. The spin-stabilizing assembly of claim 7, further comprising: a torque actuator in communication with the processor and the accelerometer, wherein the processor is configured to generate actuator control signals in response to the electronic control signal from the accelerometer, and the torque actuator is configured, in response to the actuator control signals, to apply a differential torque about the vertical center axis.

9. The spin-stabilizing assembly of claim 1, wherein the barrel is a component of a firearm configured to discharge a projectile through the distal end via the exhaust gases.

10. A spin-stabilized device comprising:

a cylindrical barrel having a distal end, a longitudinal center axis, and a vertical center axis, wherein the barrel is configured to expel exhaust gases through the distal end; and a spin-stabilizing assembly comprising:

a fixed gimbal piece having first and second ends, wherein the first end of the fixed gimbal piece is configured to circumferentially surround and engage an outer diameter surface of the barrel proximate the distal end, and wherein the second end of the gimbal piece defines a pair of coaxial through-holes centered on the vertical center axis;

a spinner cage that defines a pair of vertical posts configured to engage the pair of through-holes, wherein the spinner cage is pivotably connected to the second end of the gimbal piece about the vertical center axis via the vertical posts and through-holes; and a spinner body disposed radially within the spinner cage and defining multiple axial vanes, wherein the axial vanes are collectively configured, in response to impingement of the exhaust gases on the axial vanes, to cause the spinner body to rotate about the longitudinal center axis and thereby minimize displacement of the distal end about the vertical center axis during expulsion of the exhaust gases from the barrel, wherein the spin-stabilized device is a firearm configured to discharge a projectile from the distal end via the exhaust gases.

11. The spin-stabilized device of claim 10, wherein the gimbal piece includes an annular hub proximate the first end and one or more stops or bumpers disposed radially within the annular hub, and wherein a range of motion of the spinner cage is limited by the stops or bumpers when the spinner cage pivots about the vertical center axis.

12. The spin-stabilized device of claim 10, wherein the spinner cage includes a pair of annular end rings joined by a plurality of axial support members, at least two of which define a respective one of vertical posts.

13. The spin-stabilized device of claim 12, wherein the plurality of axial support members includes four equally-spaced axial support members disposed 90° apart from each other with respect to a circumference of the annular end rings.

14. The spin-stabilized device of claim 10, further comprising a rotary actuator connected to the spinner body and configured to rotate the spinner body about the longitudinal center axis at a calibrated rotational speed.

15. The spin-stabilized device of claim 14, further comprising:

a processor in communication with the rotary actuator; and an accelerometer connected to the distal end of the barrel in communication with the processor, wherein the accelerometer is configured to transmit an electronic signal to the processor that is indicative of a measured acceleration of the distal end of the barrel along the vertical center axis, and the processor is configured to adjust the rotational speed in response to the electronic signal.

16. A spin-stabilizing assembly for use with a cylindrical barrel of a firearm, the cylindrical barrel having a longitudinal center axis, a vertical center axis, and a distal end, the spin-stabilizing assembly comprising:

a gimbal piece having a first end and a second end, wherein the first end of the gimbal piece is configured to engage an outer diameter surface of the barrel proximate the distal end, wherein the gimbal piece includes an annular hub proximate the first end, and one or more stops or bumpers disposed radially therewithin;

a spinner cage configured to engage the second end of the gimbal piece, and to pivot with respect thereto about the vertical center axis, wherein a range of motion of the spinner cage is limited by the stops or bumpers when the spinner cage pivots about the vertical center axis; and a spinner body disposed radially within the spinner cage and defining multiple axial vanes, wherein the axial vanes are collectively configured, in response to impingement on the axial vanes by exhaust gases discharged from the distal end of the barrel when the firearm discharges a projectile, to rotate the spinner body about the longitudinal center axis and thereby minimize displacement of the distal end of the barrel along the vertical center axis.

17. The spin-stabilized device of claim 16, wherein the spinner cage includes a pair of annular end rings joined by a plurality of axial support members.

18. The spin-stabilized device of claim 17, wherein a pair of the axially support members define oppositely disposed vertical posts, and wherein the gimbal piece is connected to the spinner cage via the oppositely disposed vertical posts.

19. The spin-stabilized device of claim 18, wherein the plurality of axial support members includes four equally-spaced axial support members disposed 90° apart from each other with respect to a circumference of the annular end rings.

20. The spin-stabilized device of claim 16, wherein the spin-stabilized device is a firearm configured to discharge a projectile from the distal end via the exhaust gases.

* * * * *